US008459641B2

(12) United States Patent
Ishikawa et al.

(10) Patent No.: US 8,459,641 B2
(45) Date of Patent: Jun. 11, 2013

(54) SHEET CONVEYANCE APPARATUS AND IMAGE FORMING APPARATUS

(75) Inventors: Naoki Ishikawa, Kashiwa (JP); Hitoshi Kato, Toride (JP); Yasuo Fukatsu, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 126 days.

(21) Appl. No.: 12/825,071

(22) Filed: Jun. 28, 2010

(65) Prior Publication Data

US 2010/0327516 A1 Dec. 30, 2010

(30) Foreign Application Priority Data

Jun. 30, 2009 (JP) ..... 2009-155679
May 13, 2010 (JP) ..... 2010-111539

(51) Int. Cl.
*B65H 9/04* (2006.01)

(52) U.S. Cl.
USPC ..... 271/243; 271/245; 271/253

(58) Field of Classification Search
USPC ..... 271/228, 230, 235, 243, 245, 246, 271/253, 255, 265.04
See application file for complete search history.

(56) References Cited

U.S. PATENT DOCUMENTS 5,039,086 A * 8/1991 Matsuno et al. ..... 271/227
5,123,640 A * 6/1992 Rebeaud ..... 271/236
5,156,391 A * 10/1992 Roller ..... 271/227
5,172,898 A * 12/1992 Takahashi ..... 271/10.11
5,374,053 A * 12/1994 Doucet et al. ..... 271/243
6,789,794 B2 * 9/2004 Miyazawa ..... 271/184
2007/0267801 A1 11/2007 Wakabayashi et al.

FOREIGN PATENT DOCUMENTS

JP 53-106207 A 9/1978
JP 06-127753 A 5/1994
JP 2005-162382 A 6/2005

OTHER PUBLICATIONS

U.S. Appl. No. 13/084,387, filed Apr. 11, 2011, Masaki Maeno.
U.S. Appl. No. 12/965,774, filed Dec. 10, 2010, Ryosuke Sato.
U.S. Appl. No. 12/964,681, filed Dec. 9, 2010, Ryosuke Sato.
U.S. Appl. No. 12/945,598, filed Nov. 12, 2010, Koichiro Kawaguchi.
U.S. Appl. No. 12/941,856, filed Nov. 8, 2010, Yosui Naito.
U.S. Appl. No. 12/834,651, filed Jul. 12, 2010, Tetsuhitro Nitta.
U.S. Appl. No. 12/958,245, filed Dec. 1, 2010, Hironori Naka.

* cited by examiner

*Primary Examiner* — Michael McCullough
*Assistant Examiner* — Howard Sanders
(74) *Attorney, Agent, or Firm* — Canon U.S.A., Inc. IP Division

(57) ABSTRACT

In a sheet processing apparatus that is required for high productivity, it is needed to execute skew correction of a sheet in a short time. Thus, when the sheet is struck against a roller or a skew correction member at a high speed to execute skew correction, it may cause a scratch or a noise caused by an impact. Accordingly, the sheet is struck against a skew correction stopper that is moving at a speed slower than a sheet conveyance speed to execute skew correction.

21 Claims, 17 Drawing Sheets

FIG. 7

SHEET POSITION TO START MOVEMENT OF STRIKING STOPPER

| TIME / CONVEYANCE SPEED | Ta | Tb |
|---|---|---|
| Va | La | Lb |
| Vb | Ld | Le |

TIME THAT STOPPER MOVES TO STRIKING POSITION

FIG. 13

| | THIN PAPER | STANDARD PAPER | THICK PAPER |
|---|---|---|---|
| AMOUNT OF LOOP | SMALL | MIDDLE | LARGE |
| STRIKING POSITION | P5 | P3 | P1 |

SHEET CONVEYANCE APPARATUS AND IMAGE FORMING APPARATUS

BACKGROUND OF THE INVENTION

1. Field of the Invention

The present invention relates to a sheet conveyance apparatus that can correct a skew of a sheet that is conveyed obliquely with respect to a sheet conveyance direction to a direction along the sheet conveyance direction, and an image forming apparatus including the sheet conveyance apparatus.

2. Description of the Related Art

Conventionally, an image forming apparatus such as a copying machine, a facsimile machine, a printer, and a multifunction peripheral thereof generally includes a function of forming an image on a sheet and a function of reading a document. Then, a technique, concerning skew correction of a sheet and a document to be conveyed in order to improve accuracy of image formation and document reading, has been discussed.

In the above-described conventional skew correction, there is a method by which the skew correction is executed by striking the downstream end of a sheet in a sheet conveyance direction to a nip portion on a stopped registration roller pair to form a loop. This is a method to strike the downstream end of the sheet in the sheet conveyance direction against the nip portion on the registration roller pair, which extends in a direction orthogonal to the sheet conveyance direction to form the loop, thereby aligning the downstream end of the sheet in a direction orthogonal to the sheet conveyance direction. Thus, after a skew has been corrected, the registration roller pair is rotated, thereby causing the sheet, the skew of which has been corrected, to be conveyed.

However, the downstream end of the sheet in the sheet conveyance direction is struck against the nip portion on the registration roller pair, thereby securely correcting the skew of the sheet. However, it causes a collision noise.

Thus, there is a method to detect the downstream end of the sheet in the sheet conveyance direction by a detection unit disposed in the vicinity of the downstream in the sheet conveyance direction of the registration roller pair to once stop the conveyed sheet directly before the registration roller pair. This drives a conveyance roller on the upstream in the sheet conveyance direction in advance after the sheet has once been stopped, thereby abutting the sheet on the registration roller pair to form the loop. Thus, the skew of the sheet is corrected. At that time, since the sheet is struck on the registration roller pair before the conveyance speed of the conveyance roller is increased, the collision noise is reduced (refer to Japanese Patent Application Laid-Open No. 6-127753).

As described above, in the conventional skew correction, from the viewpoint of miniaturization and low cost, a method is used which strikes the downstream end of the conveyance sheet on a registration roller pair or a skew correction member. However, as described in Japanese Patent Application Laid-Open No. 6-127753, in order to reduce a collision noise in striking, if conveyance of a sheet is once stopped to reduce a speed, productivity is decreased. Further, because an amount of loop is constant, when a rigidity of the conveyance sheet is high, the conveyance roller may slip after the sheet is struck on the registration roller pair. As the necessary amount of loop for skew correction is not secure, excellent skew correction may not be realized.

SUMMARY OF THE INVENTION

According to an aspect of the present invention, an apparatus includes a first conveyance portion configured to convey a sheet, a second conveyance portion disposed on a downstream side of the first conveyance portion in a conveyance direction, a skew correction portion movably disposed between the first and second conveyance portions along the conveyance direction, and configured to be struck by a downstream end of the sheet conveyed by the first conveyance portion in the conveyance direction, and a controller configured to control a conveyance so that the first conveyance portion strikes the sheet against the skew correction portion that is moving at a speed slower than a conveyance speed of the sheet conveyed by the first sheet conveyance portion and conveys the sheet to the second conveyance portion with the sheet being struck, and a higher a rigidity of the sheet to be conveyed becomes, on a more upstream side a striking position between the sheet and the skew correction portion is located.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

FIG. 7 illustrates data on a sheet position to start movement of a stopper.

FIG. 13 illustrates adjustment of the amount of skew correction of the sheet processing apparatus.

DESCRIPTION OF THE EMBODIMENTS

Various exemplary embodiments, features, and aspects of the invention will be described in detail below with reference to the drawings.

It will be described below when an image forming apparatus is a copying machine. However, the image forming apparatus may also be a printer, a facsimile, or the function peripheral thereof.

Figure 1:
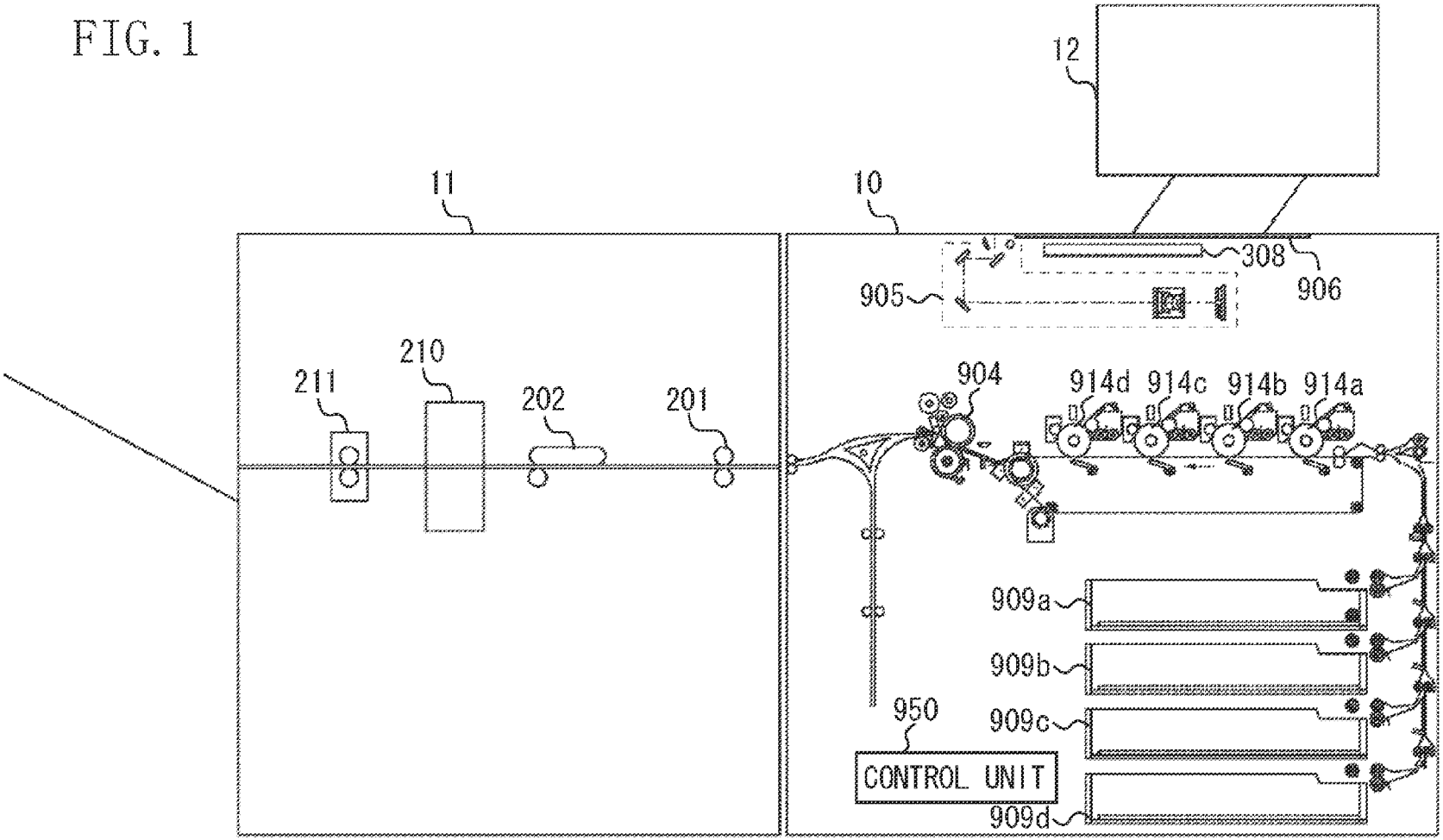
FIG. 1 illustrates a sheet processing apparatus system according to a first exemplary embodiment of the present invention.

FIG. 1 illustrates a schematic configuration of a copying machine, which is an example of an image forming apparatus according to a first exemplary embodiment of the present invention. A system will be described in which a color copying machine 10 (hereinafter, simply referred to as "copying machine") and a sheet processing apparatus 11 have been connected.

The copying machine 10 as the image forming apparatus will be described referring to FIG. 1. An image forming system in the present exemplary embodiment includes the copying machine 10 and the sheet processing apparatus 11. The sheet processing apparatus 11 as a sheet conveyance apparatus is connected to the copying machine 10, and includes a skew correction mechanism according to the present invention and a punch unit as a sheet processing portion. Thus, a sheet to be discharged from the copying machine 10 can be processed online.

The sheet processing apparatus 11 may be used as an option. The copying machine 10 can also individually be used. Further, the sheet processing apparatus 11 and the copying machine 10 may also be integrated.

On a sheet supplied from cassettes 909*a* to 909*d* in the copying machine 10, a four color toner image is transferred by a yellow, a magenta, a cyan, and a black photoreceptor drums 914*a* to 914*d*, each of which is an image forming portion. Then, the sheet is conveyed to a fixing unit 904, a toner image is fixed thereon, and the sheet is discharged outside the machine.

The copying machine 10 includes an operation unit 12 configured to allow a job and paper information, which is set in a cassette, to be input. In such a system, a user or a service person can arbitrarily set the amount of skew correction of a skew correction mechanism through the operation unit 12 on the copying machine 10.

Figure 2:
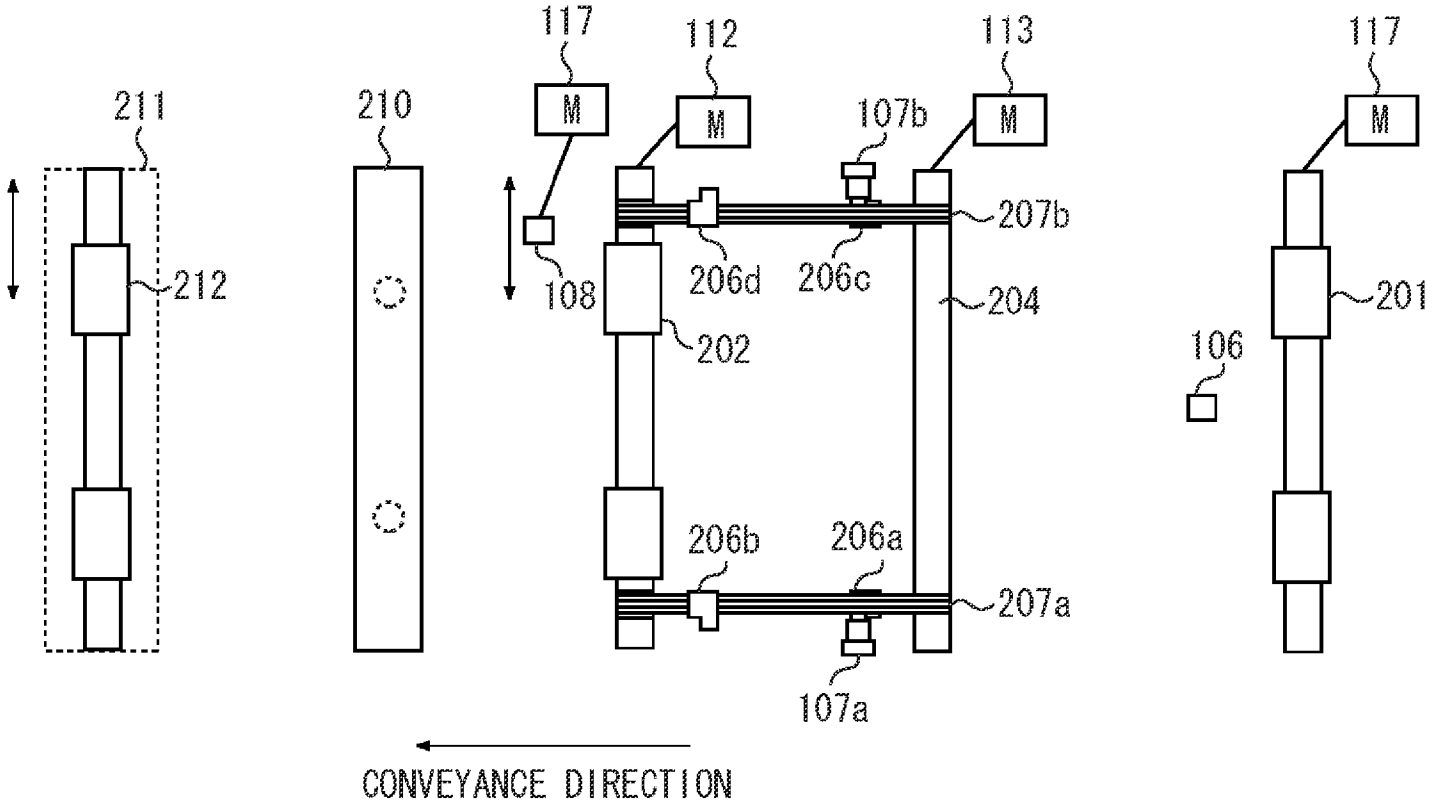
FIG. 2 illustrates skew correction of the sheet processing apparatus.

FIG. 2 is a plan view illustrating a skew correction mechanism according to the first exemplary embodiment of the present invention. FIG. 3 illustrates an operation when a sheet conveyance apparatus including a skew correction mechanism according to the first exemplary embodiment of the present invention executes skew correction of a sheet.

As illustrated in FIG. 2, the skew correction mechanism according to the present exemplary embodiment includes a first conveyance roller 201 as a first sheet conveyance portion configured to convey a sheet, and a second conveyance roller 202 as a second sheet conveyance portion. The second conveyance roller 202 is disposed downstream in a sheet conveyance direction of the first conveyance roller 201. The first conveyance roller 201 and the second conveyance roller 202 have a first conveyance motor 111 and a second conveyance motor 112, which are driving sources therefore respectively.

A belt roller 204 is arranged between the first conveyance roller 201 and the second conveyance roller 202. Belts 207*a* and 207*b* are stretched over the belt roller 204 and the second conveyance roller 202. The belts 207*a* and 207*b* are configured to idle a mounting portion with the second conveyance roller 202 so as not to transmit drive of the second conveyance roller 202. The belt roller 204 can be rotated by a skew correction stopper motor 113, which is a driving source.

The belts 207*a* and 207*b* include a skew correction stopper 206 (206*a*, 206*b*, 206*c*, and 206*d*) serving as a skew correction member. The stoppers 206*a* and 206*c* are disposed in parallel to a shaft of the first conveyance roller 201 and the second conveyance roller 202 so as to allow skew correction when the sheet has been struck. The skew correction stoppers 206*a* and 206*c* are disposed in a position where the sheet can be received in a conveyance path.

The skew correction stoppers 206*b* and 206*d* are also mounted in a diagonal position to the skew correction stoppers 206*a* and 206*c*. The skew correction stoppers 206*a*, 206*b*, 206*c*, and 206*d* can move in the conveyance path and retreat outside the conveyance path by rotating the belts 207*a* and 207*b*.

Further, between the belt roller 204 and the second conveyance roller 202, a skew correction stopper HP sensor 107 (107*a* and 107*b*) for detecting positions of the skew correction stoppers 206*a*, 206*b*, 206*c*, and 206*d* is included. On the conveyance path, a sheet detection sensor 106 is disposed. Operation start timing of the skew correction stoppers 206*a*, 206*b*, 206*c*, and 206*d* is determined based on detection of the sheet by the sheet detection sensor 106.

Furthermore, a loop space (not illustrated) is provided upstream in a sheet conveyance direction of the second conveyance roller 202 so as to allow a loop, which is formed in skew correction of the sheet by the skew correction stoppers 206*a*, 206*b*, 206*c*, and 206*d* to be permitted.

A horizontal registration detection sensor 108 is disposed downstream in the sheet conveyance direction of the second conveyance roller 202. The horizontal registration detection sensor 108 can move in a width direction that is orthogonal to the sheet conveyance direction by a horizontal registration detection sensor movement motor 117. The horizontal registration detection sensor 108 moves in a direction orthogonal to the sheet conveyance direction, detects the end in the width direction of the sheet, and calculates the amount of displacement from a reference position in the width direction of the sheet.

The sheet conveyance apparatus in the present exemplary embodiment makes a center of the sheet in a direction orthogonal to the sheet conveyance direction coincide with a center of the conveyance path in a direction orthogonal to the sheet conveyance direction to convey the sheet. In other words, conveyance of the sheet is executed based on the center.

A shift unit 211 executes correction of displacement in the width direction of the sheet based on the amount of displacement of the sheet. The shift unit 211 has a shift conveyance roller 212 for conveying the sheet to the sheet conveyance direction. The shift conveyance roller 212 is driven by a shift conveyance motor 115 arranged on the shift unit 211.

Still furthermore, the shift unit 211 moves in the width direction that is orthogonal to the sheet conveyance direction by a shift movement motor 116 mounted on the apparatus main body. Thus, the shift conveyance roller 212 can also move in the width direction. The shift conveyance roller 212 can execute correction of displacement in the width direction while conveying the sheet based on the amount of displacement of the sheet determined by the result of detection of the horizontal registration detection sensor 108

A punch unit 210 as a sheet processing portion is disposed between the second conveyance roller 202 and the shift conveyance roller 212, and can execute punch processing to the sheet. The punch unit 210 includes a punch portion and a dice portion (not illustrated). A punch and a dice are meshed, and thereby holes can be formed with the conveyed sheet during that time.

Figures 3A, 3B, 3C:
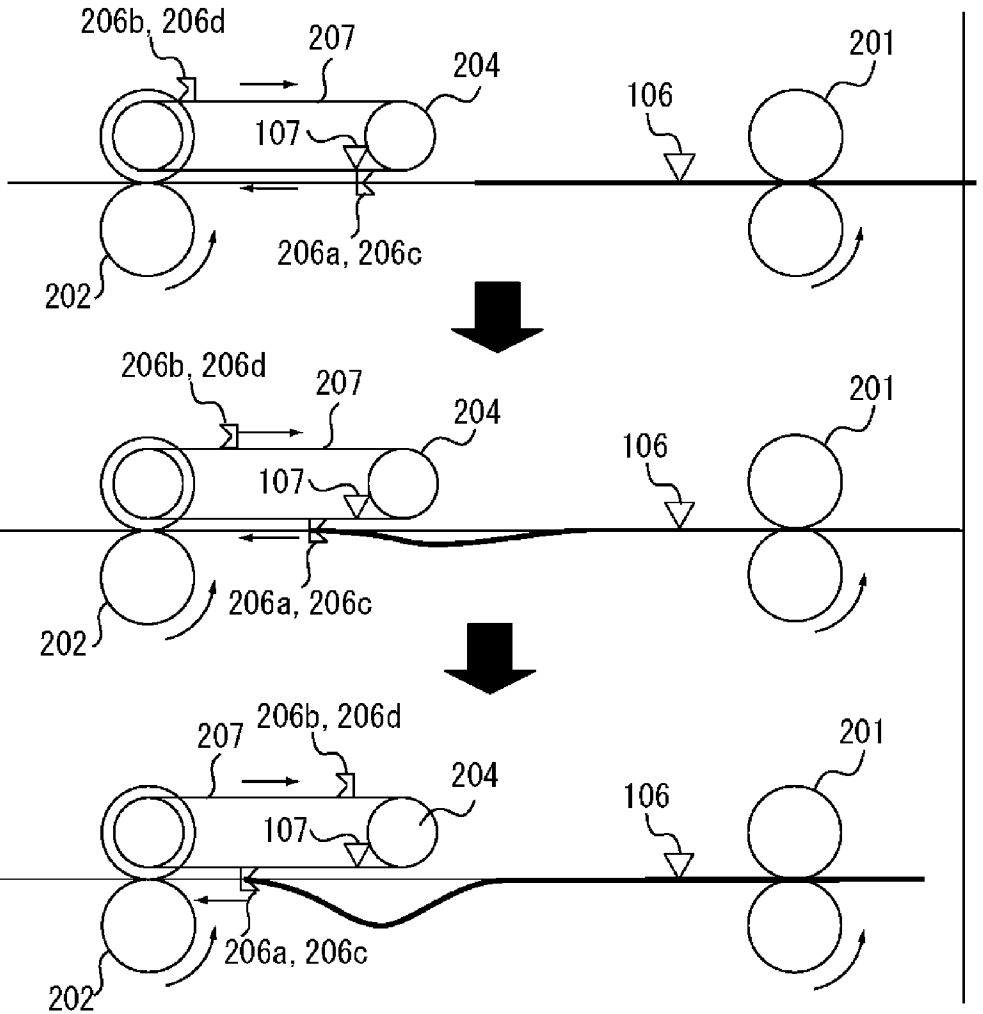
FIGS. 3A, 3B and 3C illustrate skew correction of the sheet processing apparatus.

FIG. 3 illustrates an operation in skew correction of a sheet. Skew correction of a sheet is executed by striking the sheet to the skew correction stopper 206 (206*a* and 206*c*) as a skew correction member. Until the sheet is conveyed, the skew correction stopper 206 stands by in an HP position (hereinafter, referred to as standby position), which is detected by the skew correction stopper HP sensor 107 illustrated in FIG. 3A.

In the present exemplary embodiment, in order to reduce an impact when the sheet is struck, the sheet is struck while the skew correction stopper 206 is moving in a sheet conveyance direction, a loop is generated, and skew correction is executed. Since a striking position between the sheet and the skew correction stopper 206 is to be fixed in order to obtain the correct amount of loop for executing secure skew correction, the skew correction stopper 206 stands by in a standby position until the sheet reaches the movement start position of the stopper.

In FIG. 3, the movement start position of the stopper is a position where the sheet reaches, which has been set upstream in a sheet conveyance direction with respect to the standby position of the skew correction stopper 206. The skew correction stopper 206 detects that the sheet has reached the movement start position and starts movement. Time that the sheet reaches the striking position is calculated from a sheet conveyance speed. This movement start position is determined by a distance in which the skew correction stopper 206 moves within that time.

More specifically, when the sheet conveyed by the first conveyance roller 201 at a sheet conveyance speed V1 reaches the movement start position of the stopper, the belt roller 204 is rotated. Thus, the skew correction stopper 206 starts movement along the sheet conveyance direction. When the skew correction stopper 206 accelerates until at a predetermined movement speed V2 and reaches the predetermined striking position while keeping the movement speed V2, the downstream end (tip) of the sheet in the sheet conveyance direction is struck on the skew correction stopper 206 as illustrated in FIG. 3B.

The sheet conveyance speed V1 of the first conveyance roller 201 and the movement speed V2 of the skew correction stopper 206 at this time have a relation of expression V1>V2. The upstream end (rear end) of the sheet in the sheet conveyance direction is conveyed at the sheet conveyance speed V1 faster than at the movement speed V2 of the skew correction stopper 206. Thus, a loop is formed due to a speed difference between the tip and the rear end of the sheet, and a skew is corrected as illustrated in FIG. 3C.

As described above, the skew correction stopper 206 moves in the sheet conveyance direction at a movement speed slower than a sheet conveyance speed, thereby allowing an impact in striking to be reduced, and occurrence of damage of the sheet to be reduced. The smaller the speed difference between the sheet conveyance speed in striking and the movement speed of the skew correction stopper 206 becomes, the more the impact to the sheet when the sheet is struck is reduced.

Rotation thereof is continued until the tip of the sheet is struck on the skew correction stopper 206, the sheet is conveyed with a loop formed, the tip of the sheet is passed through the second conveyance roller 202, and the skew correction stopper 206 retreats outside the conveyance path. After the retreat, the skew correction stopper 206 stands by in the standby position for arrival of the next sheet to the movement start position. The sheet is guided to the second conveyance roller 202 with the tip of the sheet struck on the skew correction stopper 206, a skew is corrected, and delivery is executed to the second conveyance roller 202 while keeping the skew correction state.

Figure 4:
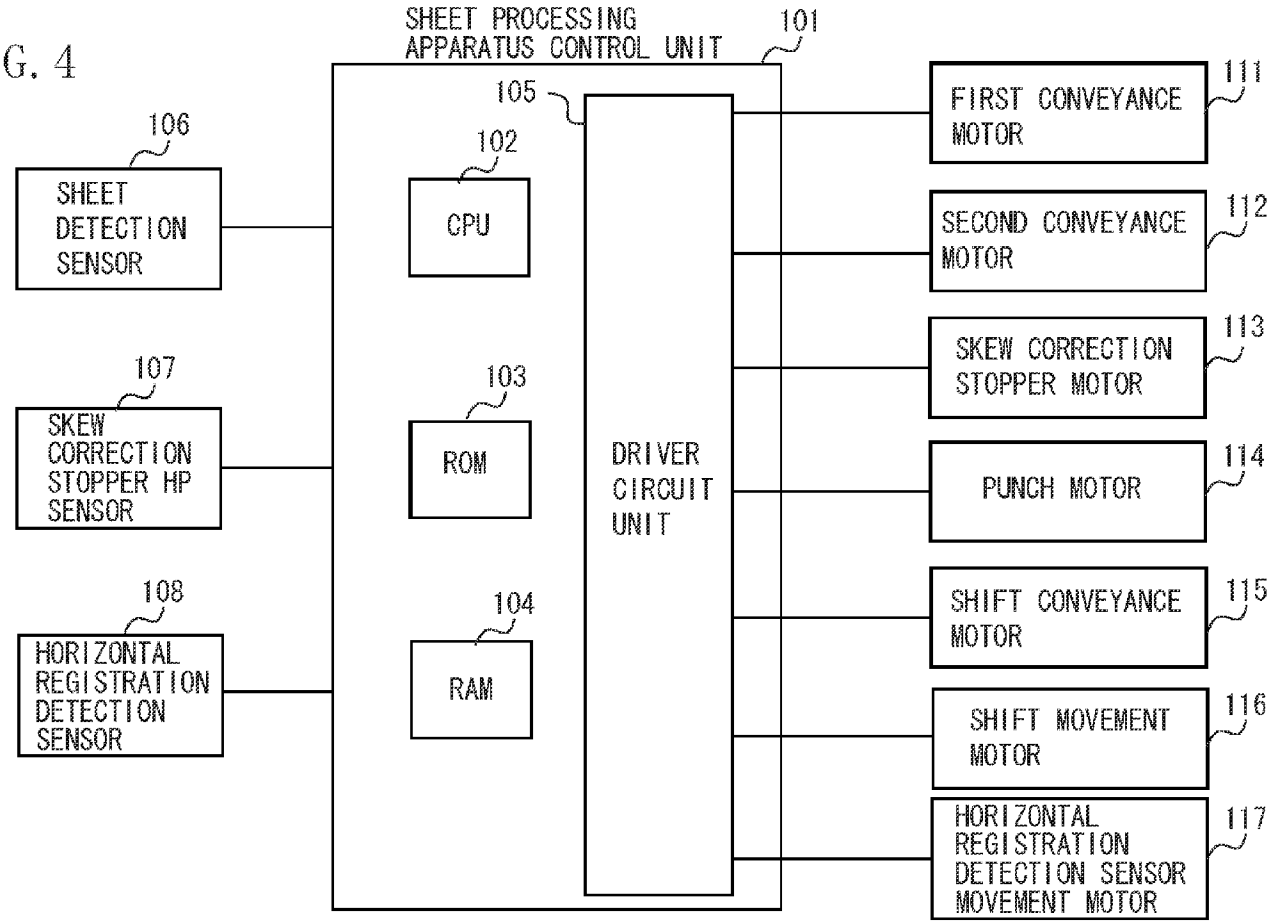
FIG. 4 is a block diagram illustrating the sheet processing apparatus.

Next, control of a sheet processing apparatus will be described referring to a block diagram in FIG. 4.

A sheet processing apparatus control portion 101, served as a controller, is configured to include a central processing unit (CPU) 102, a read only memory (ROM) 103, a random access memory (RAM) 104, and a driver circuit unit 105. Various types of actuators and sensors in the sheet processing apparatus are controlled based on a control program stored in the ROM 103. For example, the skew correction stopper HP sensor 107, the first conveyance motor 111, the second conveyance motor 112, the skew correction stopper motor 113, and the shift conveyance motor 115 are controlled by the sheet processing apparatus control portion 101.

The sheet processing apparatus control portion 101 communicates with a control portion 950 (refer to FIG. 1) mounted on the copying machine 10 to control the sheet processing apparatus 11 based on various settings concerning image formation, information concerning a sheet, and the like.

Next, an operation in punch processing, which is sheet processing in the present exemplary embodiment, will be described referring to FIG. 5.

Figures 5A, 5B, 5C:
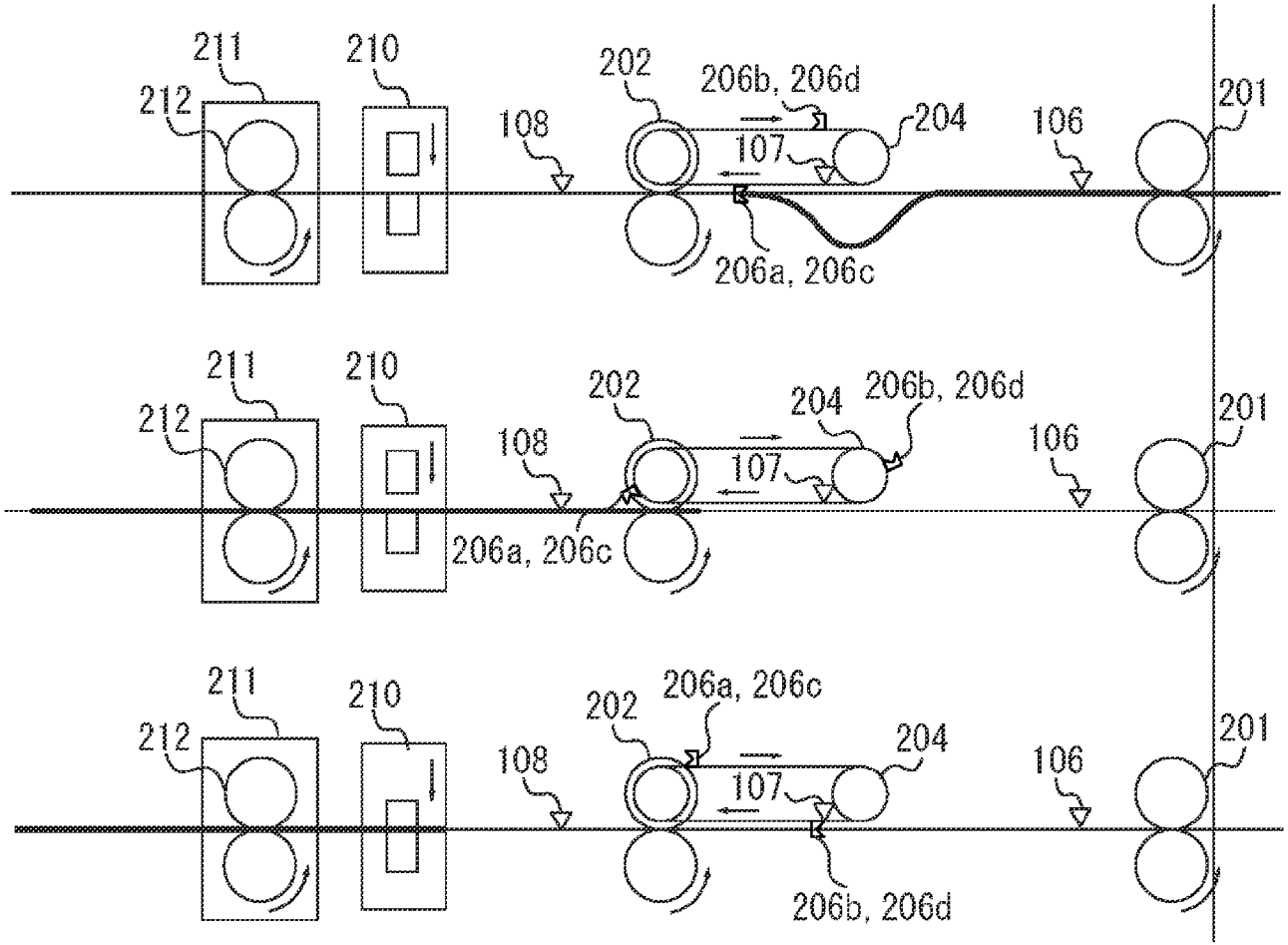
FIGS. 5A, 5B and 5C illustrates skew correction of the sheet processing apparatus.

As illustrated in FIG. 5, when skew correction of a sheet is completed as illustrated in FIG. 5A by the operation described in FIG. 3, the sheet is conveyed downstream in a sheet conveyance direction by the second conveyance roller 202. In the conveyed sheet, the end in the width direction of the sheet is detected by the horizontal registration detection sensor 108 as illustrated in FIG. 5B, and the amount of displacement in the width direction is calculated. When the sheet reaches the shift unit 211, the shift unit 211 executes correction of displacement in the width direction of the sheet based on the calculated amount of displacement.

After correction of displacement in the width direction of the sheet, when the sheet reaches the punch processing position, the shift conveyance roller 212 is stopped, and the punch unit 210 executes punch processing to the stopped sheet as illustrated in FIG. 5C. The shift conveyance roller 212 is moved again after the punch processing to execute conveyance of the sheet.

As described above, when executing skew correction, the sheet is struck on the skew correction stopper 206 during movement in the sheet conveyance direction, thereby allowing an impact in striking to be reduced. Thus, damage to the sheet can be reduced also in high-speed conveyance.

Figure 6:
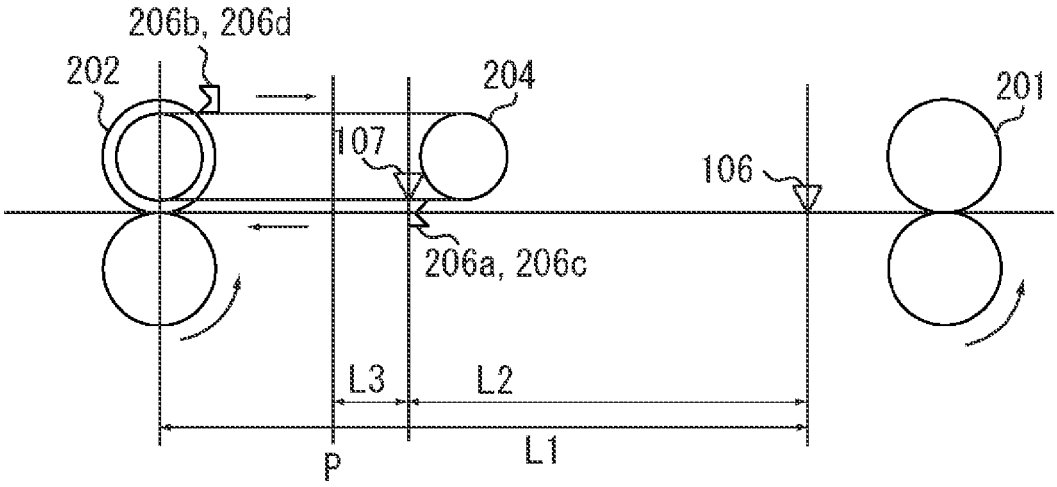
FIG. 6 illustrates an operation of a skew correction stopper on the sheet processing apparatus.

Next, a method for calculating movement start timing of a stopper will be described referring to FIG. 6.

The start of movement of the skew correction stopper 206 is executed based on a detection signal that is output when a conveyance sheet has been detected by the sheet detection sensor 106 provided in an upstream of a standby position of the skew correction stopper 206 in a sheet conveyance direction. First, time to reach a striking position P from an HP (standby) position of the skew correction stopper 206, which is detected by the skew correction stopper HP sensor 107, is calculated. A conveyance distance, in which the sheet is conveyed by the first conveyance roller 201 at the sheet conveyance speed V1, is calculated in this time. Based on the result of this calculation, the number of motor clocks for the first conveyance motor 111, which drives the first conveyance roller 201, is counted to calculate a sheet position (timing) where movement of the skew correction stopper 206 is started.

The following equation holds based on uniformly accelerated velocity motion equation:

$$V=VO+a\times t \tag{1}$$

$$V^2-VO^2=2\times a\times S \tag{2}$$

Time T1 when the skew correction stopper 206 reaches the striking position from the standby position is given by equation (3) based on equation (1) and equation (2).

$$T1=V2/a+(\text{time of movement at movement speed } V2)=V2/a+((L3-V2^2)/2a)/V2 \quad (3)$$

where an initial speed is 0, V2 is a movement speed of the stopper, and "a" is acceleration of the stopper.

Further, a conveyance distance L4 during a time T1 is given by equation 4.

$$L4=V1\times T1=V1\times(V2/a+(L3-V2^2)/(2\times a)/V2) \quad (4)$$

where V1 is a sheet conveyance speed.

Consequently, start of movement of the skew correction stopper 206 may be executed when the sheet has reached upstream in the sheet conveyance direction by the conveyance distance L4 from the striking position. Whether the sheet has reached the movement start position is determined by counting the number of motor clocks for the first conveyance motor 111 based on the sheet detection by the sheet detection sensor 106 to calculate the sheet position from the amount of movement in the motor.

The sheet conveyance speed is changed by a paper discharge mode of a sheet. A sheet conveyance speed, when a paper is discharged face up, in other words, a paper is discharged with an image formation face turned upward, is Va. A sheet conveyance speed, when a paper is discharged face-down, in other words, reversed conveyance is executed, and a paper is discharged with an image formation face turned downward, is Vb, which is faster than Va. The movement start timing of the stopper to be determined as described above is illustrated in FIG. 7.

Data on the sheet conveyance distance La to Le calculated from sheet conveyance speeds Va and Vb, and time of movement Ta and Tb to the striking position is stored in the ROM 103 on the sheet processing apparatus control portion 101. When executing a job, corresponding data is set from among sheet conveyance distances La to Le stored in the ROM 103, thereby starting movement of the stopper.

Further, the amount of loop (difference between actual sheet length of from nip position of first conveyance roller 201 to striking position and distance in sheet conveyance direction) to be formed in skew correction is determined as follows:

$$T2=(L1-L2-L3)/V2 \quad (5)$$

where T2 is time to form the loop.

$$Lp=(V1-V2)\times T2=(V1-V2)(L1-L2-L3)/V2 \quad (6)$$

where Lp is the amount of loop.

Consequently, the striking position P is changed in a direction parallel with the sheet conveyance direction, thereby allowing the amount of loops, which is formed in skew correction, to be changed.

The striking position is configured to be arbitrarily settable by changing the movement timing of the stopper. The striking position is configured to be changeable. Thus, according to the rigidity of a sheet, for example, when the thickness of the sheet is thick (the rigidity of a sheet is high), the striking position moves upstream in the sheet conveyance direction so that the amount of loop is increased. The thicker the sheet becomes, the more hardly the sheet is deformed. Thus, after the downstream end of the sheet in the sheet conveyance direction is struck on the stopper, the conveyance roller may slip. As the necessary amount of loop for skew correction is not secure, the downstream end of the sheet is hardly aligned in a direction orthogonal to the sheet conveyance direction. Accordingly, when the sheet is thick, the amount of loop is increased, thereby realizing excellent skew correction.

Figure 8:
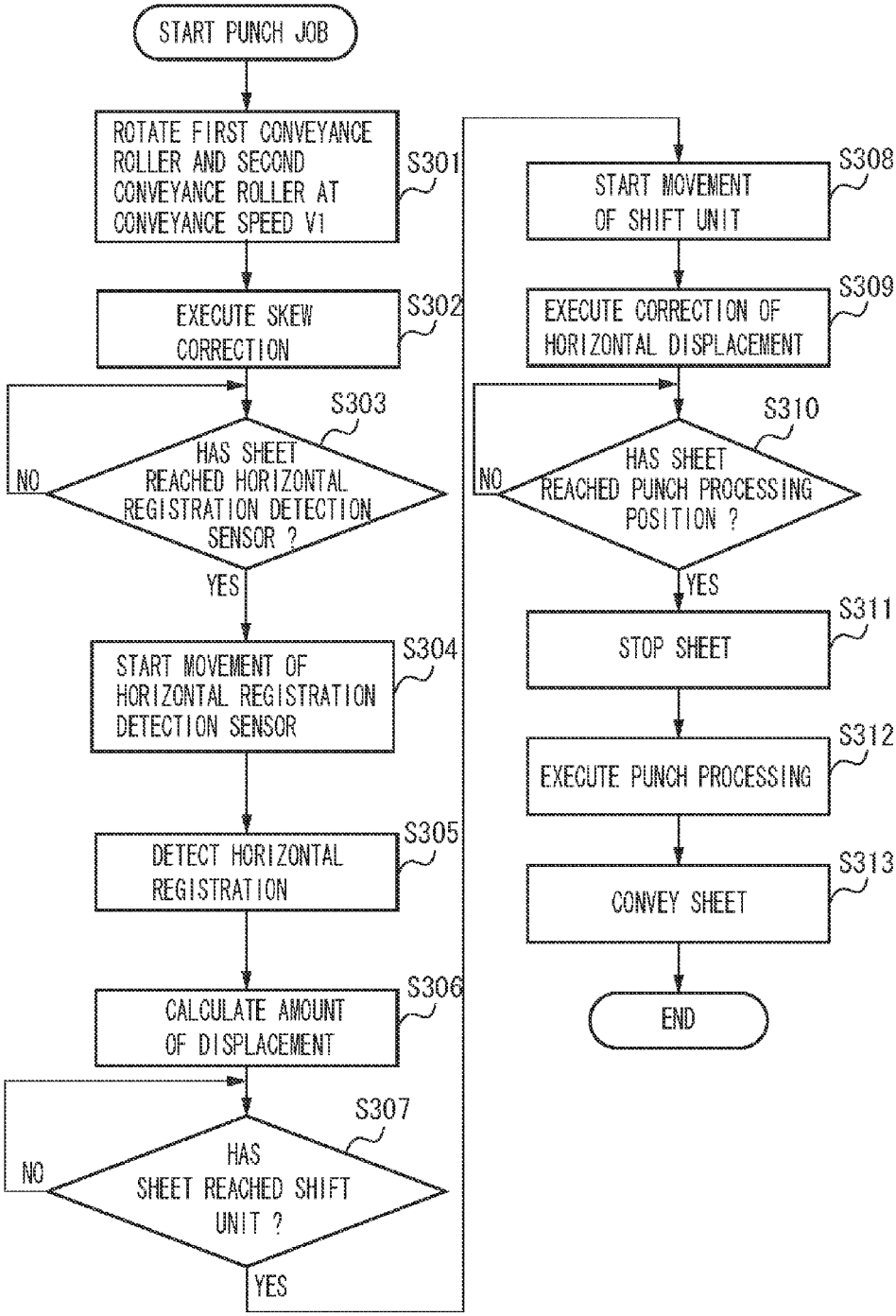
FIG. 8 is a flowchart illustrating punch processing.

Next, an operation in punch processing will be described referring to a flowchart in FIG. 8.

When a punch job is started, in step S301, the first conveyance roller 201 and the second conveyance roller 202 start rotating at the sheet conveyance speed V1. Then, in step S302, skew correction is executed to a conveyed sheet.

In step S303, after skew correction has been completed, it is determined whether the sheet has reached the horizontal registration detection sensor 108. When it is determined that the sheet has reached the horizontal registration detection sensor 108 (YES in step S303), the processing proceeds to step S304. In step S304, movement of the horizontal registration detection sensor 108 is started.

In step S305, when the horizontal registration detection sensor 108 detects the end of the sheet in a width direction orthogonal to the sheet conveyance direction, in step S306, the amount of displacement of the sheet in the width direction is calculated based on the result of the detection. The sheet is conveyed downstream in the sheet conveyance direction. In step S307, it is determined whether the sheet has reached the shift unit 211.

When it is determined that the sheet has reached the shift unit 211 (YES in step S307), in step S308, the shift unit 211 starts movement in the width direction based on the amount of displacement of the sheet calculated in step S306. In step S309, correction of displacement of the sheet in the width direction is executed.

In step S310, after the correction of displacement of the sheet has been completed, it is determined whether the sheet has reached the punch processing position. When it is determined that the sheet has reached the punch processing position (YES in step S310), in step S311, the sheet is stopped. When the sheet is stopped, in step S312, the punch processing is executed on the sheet. In step S313, after the punch processing has been completed, conveyance of the sheet is started again.

Figure 9:
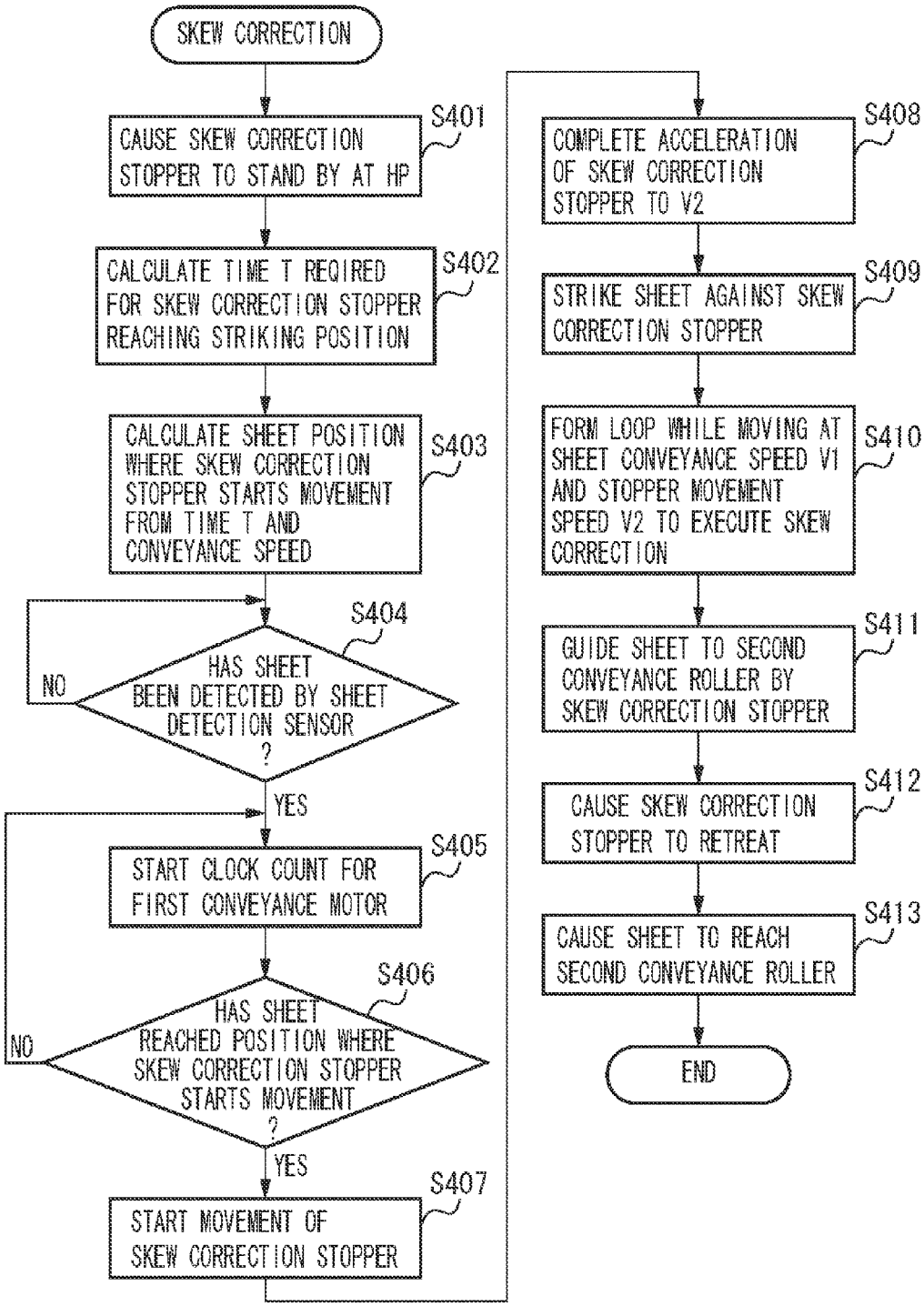
FIG. 9 is a flowchart illustrating skew correction of the sheet processing apparatus.

Next, an operation in skew correction will be described referring to a flowchart in FIG. 9.

First, in step S401, the skew correction stopper 206 stands by at a position to be detected by the skew correction stopper HP sensor 107. In step S402, time T required for the skew correction stopper 206 reaching the striking position is calculated from a sheet conveyance speed corresponding to the set paper discharge mode. Then, in step S403, the corresponding movement start position is set from among data concerning the sheet position to start movement of the skew correction stopper 206, which is stored in advance.

Next, in step S404, it is determined whether the sheet has been detected by a sheet detection sensor. When it is determined that the sheet has been detected (YES in step S404), in step S405, the clock count of the first conveyance motor 111 is started, and the sheet position is calculated.

In step S406, it is determined whether the sheet has reached the movement start position of the skew correction stopper 206 set in step S403. When it is determined that the sheet has reached the movement start position of the skew correction stopper 206 (YES in step S406), in step S407, movement of the skew correction stopper 206 is started.

When acceleration of the skew correction stopper 206 to the movement speed V2 is completed, in step S408, the skew correction stopper 206 moves to the striking position P while keeping the constant speed V2. In step S409, the sheet is struck on the skew correction stopper 206. In step S410, a loop is formed, while the rear end of the sheet is moving at the sheet conveyance speed V1 and the tip of the sheet is moving at the movement speed V2, to execute skew correction.

In step S411, the sheet subjected to skew correction is guided to the second conveyance roller 202 by the skew correction stopper 206. In step S412, when guiding the sheet subjected to skew correction to the second conveyance roller 202, the skew correction stopper 206 retreats outside the conveyance path. In step S413, after the skew correction stopper 206 has retreated, the sheet reaches the second conveyance roller 202. In step S414, the skew correction stopper 206 moves to the standby position, and then is stopped to stand by for the next sheet.

As described above, the tip of a sheet is struck on the skew correction stopper 206 that is moving while keeping a fixed movement speed. Thus, stable skew correction can be executed in the limited section between the first conveyance roller 201 and the second conveyance roller 202.

Further, the sheet processing apparatus in the present exemplary embodiment is configured to have the function of changing the striking position between the skew correction stopper 206 and the tip of a sheet according to information concerning a rigidity of a sheet (type of paper, thickness, grammage, etc.), a paper discharge mode, or the like to adjust the amount of loop. A change of the amount of loop in skew correction will be described below.

As illustrated in FIG. 1, the copying machine 10 includes the operation unit 12 capable of inputting a job, sheet information set in a cassette, or the like. In the present exemplary embodiment, a user or a service person can set the arbitrary amount of loop necessary for skew correction by the operation unit 12. The input setting and information are transmitted to the sheet processing apparatus control portion 101 via the control portion 950 on the side of the copying machine 10, and a change of the amount of loop is executed.

Figure 10:
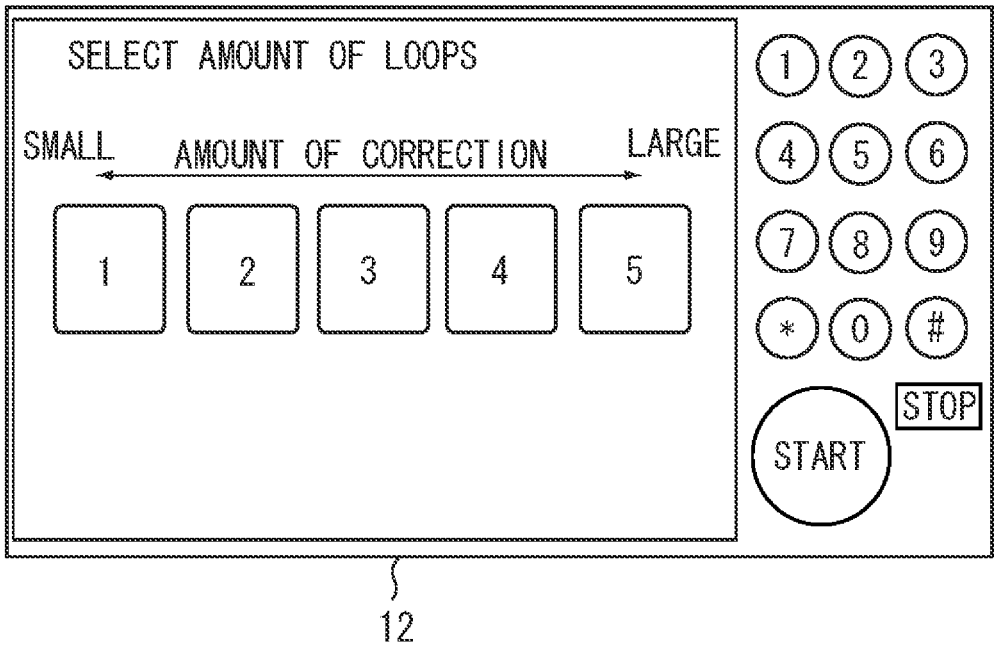
FIG. 10 illustrates an operation unit.
Figure 11:
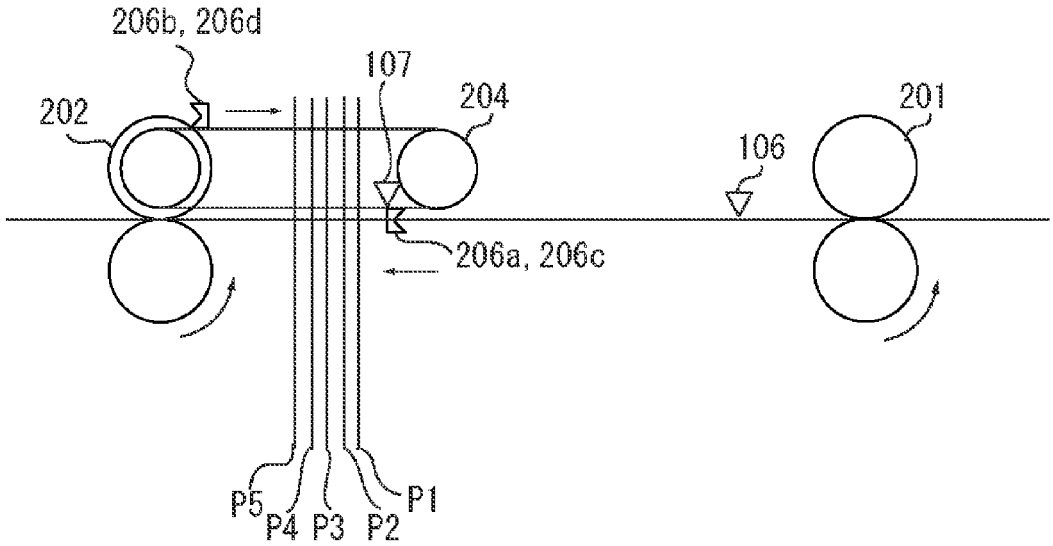
FIG. 11 illustrates setting of a striking position.

In the present exemplary embodiment, as illustrated in FIG. 10, the amount of loop can be set into five levels from the operation unit 12. When the amount of loop is set through the operation unit 12, in the sheet processing apparatus 11, the striking position between the sheet and the skew correction stopper 206 in skew correction is changed in order to change the amount of loop. As illustrated in FIG. 11, the striking position can be changed in five levels of P1 to P5 in parallel to a sheet conveyance direction.

By changing the striking position, a distance is changed between when the sheet is struck on the skew correction stopper 206 and when the sheet is conveyed to the second conveyance roller 202 while the skew correction stopper 206 is keeping a speed difference with a sheet conveyance speed. Thus, the amount of loop can be adjusted. In the operation unit 12 illustrated in FIG. 10, the amount of loop is provided with a maximum setting in a striking position P1 on the upstream side in the sheet conveyance direction, and the amount of loop is provided with a minimum setting in a striking position P5 on the downstream side in the sheet conveyance direction.

Figure 12:
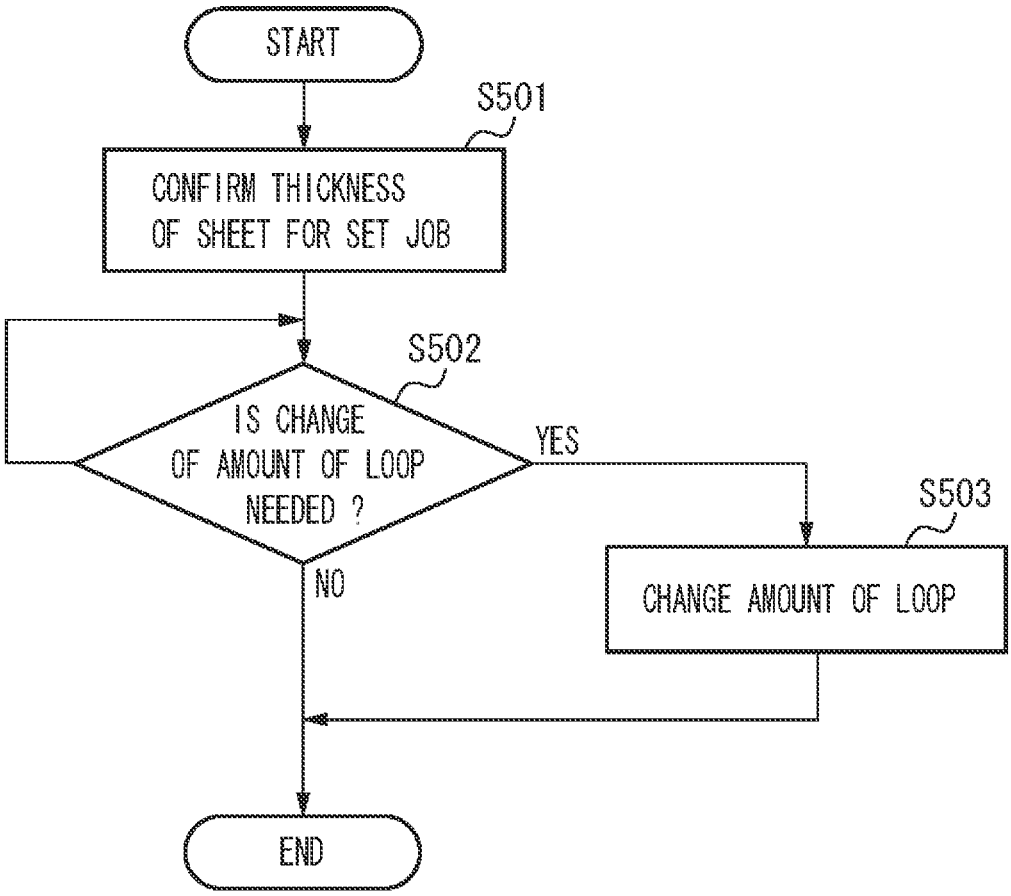
FIG. 12 is a flowchart illustrating adjustment of the amount of skew correction of the sheet processing apparatus.

Next, control of adjustment of the amount of loop in this case will be described referring to flowchart in FIG. 12. First, in step S501, information concerning a sheet of the set job is confirmed. Next, in step S502, it is determined whether a change is needed from the amount of loop, which is determined in advance in response to the thickness of the sheet. When it is determined that a change of the amount of loop of the sheet is not needed (NO in step S502), the setting of the amount of loop ends without changing the amount of loop that is determined in advance. When it is determined that a change of the amount of loop is needed (YES in step S502), in step S503, the amount of loop according to a sheet is set.

The amount of skews according to the thickness of a sheet, which is used for the determination in step S502, is determined as illustrated in FIG. 13. When the thickness of the sheet is thinner than the predetermined thickness, the amount of loop is set to small, and the striking position is set to P5. When the thickness of the sheet is the predetermined thickness, the amount of loop is set to medium and the striking position is set to P3.

Then, when the thickness of the sheet is thicker than the predetermined thickness, the amount of loop is set to large and the striking position is set to P1. A sheet whose thickness is thicker than the predetermined thickness is hardly deformed. However, the amount of loop is made large, thereby allowing excellent skew correction to be realized.

Next, a second exemplary embodiment of the present invention will be described below. In the present exemplary embodiment, a sheet is struck during acceleration of the skew correction stopper 206 to execute skew correction. An operation at that time will be described referring to FIG. 14.

First, the skew correction stopper 206 stands by in an HP (standby) position that is detected by the skew correction stopper HP sensor 107 to calculate an acceleration distance L10 for acceleration to a movement speed V3, which is equal to or slower than the sheet conveyance speed V1. Thereafter, based on the result of calculation, the skew correction stopper 206 moves upstream in the sheet conveyance direction from the second conveyance roller 202 by the acceleration distance L10 (refer to FIG. 14A).

Figures 14A, 14B, 14C:
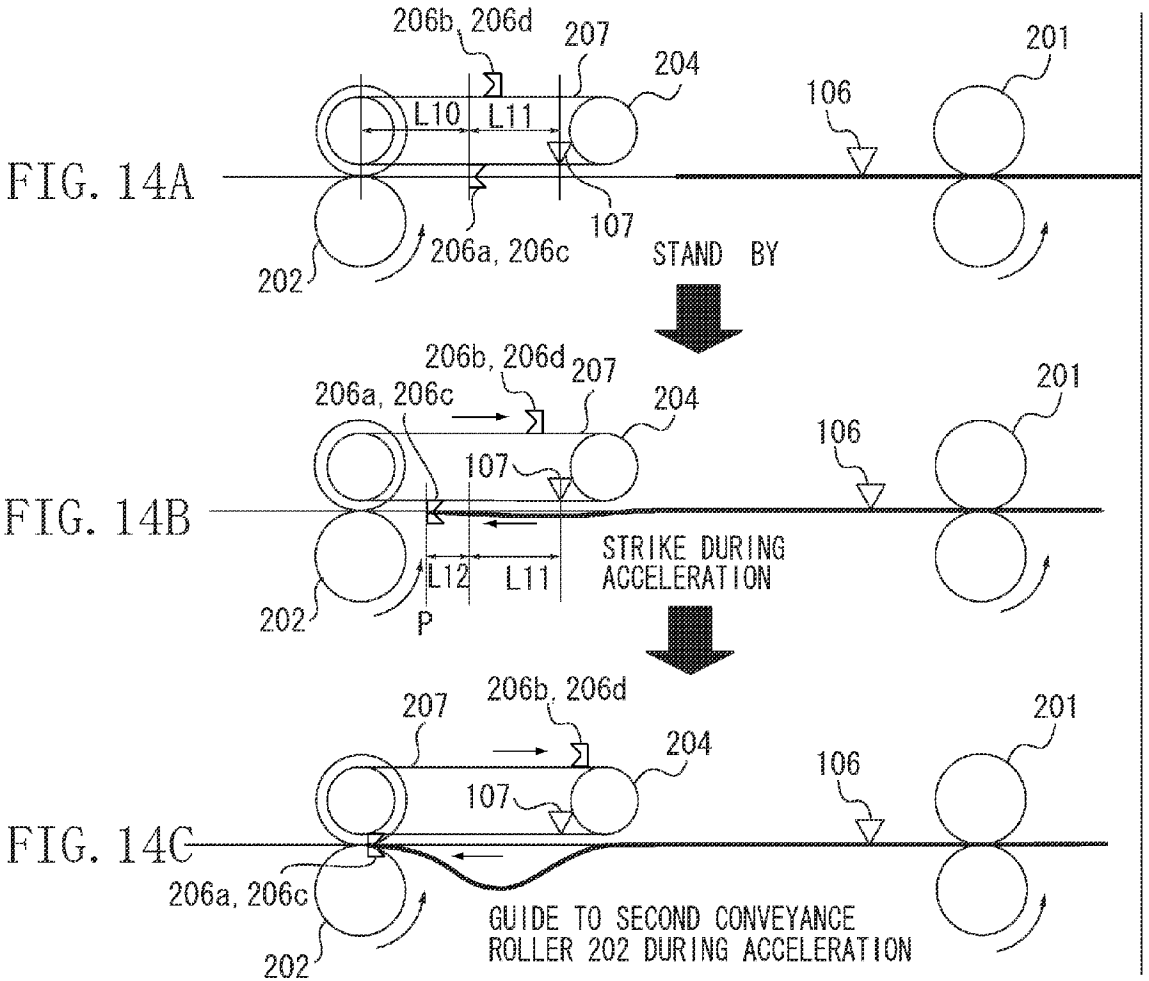
FIGS. 14A, 14B and 14C illustrate skew correction according to a second exemplary embodiment of the present invention.

Next, time T10 required to reach the striking position from the moved position is calculated. Based on this time, a sheet position where the skew correction stopper 206 starts movement is calculated. When the sheet reaches the movement start position, in the skew correction stopper 206, acceleration to the movement speed V3 is started. The sheet being conveyed at the sheet conveyance speed V1 is struck on the skew correction stopper 206 in the striking position P during acceleration of the skew correction stopper 206 as illustrated in FIG. 14B.

Further, the skew correction stopper 206 continues acceleration to the movement speed V3. During this time, a loop is formed due to a speed difference, and skew correction is executed. When the skew correction stopper 206 completes acceleration to the movement speed V3, it simultaneously reaches the second conveyance roller 202 as illustrated in FIG. 14C. Then, the skew correction stopper 206 retreats outside the conveyance path. The sheet subjected to skew correction is guided to the second conveyance roller 202 by the skew correction stopper 206 and delivery is executed while keeping the skew correction state.

As described above, also by executing skew correction during acceleration of the skew correction stopper 206, similarly to the first exemplary embodiment, damage to a sheet caused by an impact in striking in high-speed conveyance can be reduced. Further, also after a sheet has been struck, the skew correction stopper 206 accelerates. Thus, damage to a sheet is further reduced.

Next, a method for calculating the acceleration distance L10, time T10, and the sheet conveyance position when starting movement of the skew correction stopper 206 will be described using equation (7) and equation (8).

$$V^2-VO^2=2\times a\times S \tag{7}$$

$$S=VO\times t+(1/2)\times a\times t^2 \tag{8}$$

The acceleration distance L10 is given by:

$$L10=V3^2/2\times a \tag{9}$$

where an initial speed is 0, V3 is movement speed of the skew correction stopper 206, and "a" is acceleration of the skew correction stopper 206.

Time T10 required to reach the striking position P from the standby position is given by:

$$L10=\sqrt{(2\times L12/a)} \quad (10)$$

A conveyance distance L13 at the sheet conveyance speed V1 and during a time T10 is given by:

$$L13=V1\times T10=V1\times\sqrt{(2\times L12/a)} \quad (11)$$

Consequently, the movement start position of the skew correction stopper 206 is a point where the sheet reaches upstream in the sheet conveyance direction by the conveyance distance L13 from the standby position.

Also in the present exemplary embodiment, similarly to the first exemplary embodiment, a change of the amount of loop in skew correction can be executed.

Figure 15:
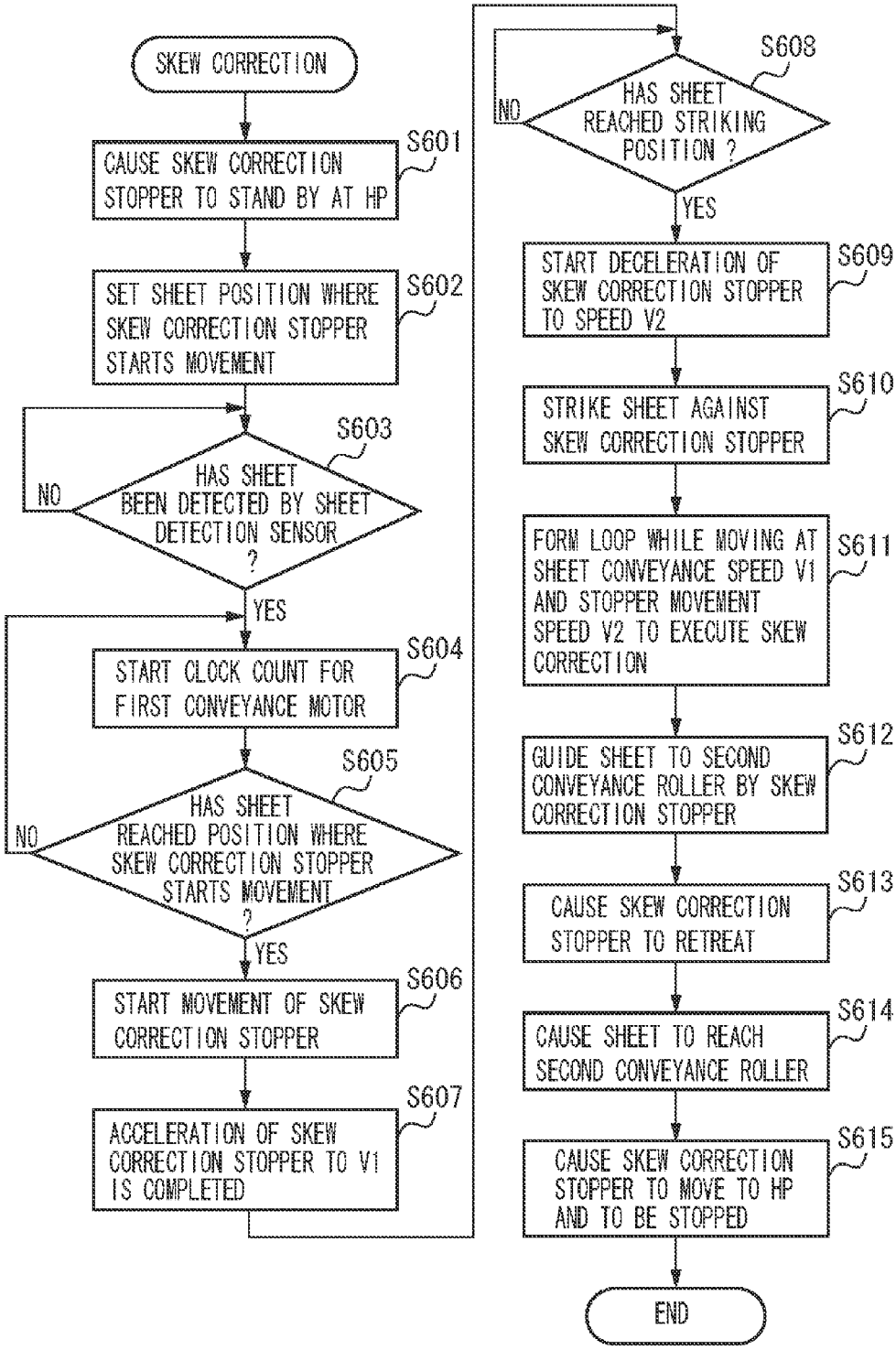
FIG. 15 is a flowchart illustrating skew correction of a sheet processing apparatus according to a third exemplary embodiment of the present invention.

Next, a third exemplary embodiment of the present invention will be described below. Skew correction in the present exemplary embodiment will be described referring a flowchart in FIG. 15.

As illustrated in FIG. 3, in step S601, the skew correction stopper 206 stands by at a position where the skew correction stopper 206 is detected by the skew correction stopper HP sensor 107. Then, in step S602, the corresponding data is set from among data concerning the sheet position for starting movement of the skew correction stopper 206 that is stored in advance.

Next, in step S603, it is determined whether a sheet has been detected by a sheet detection sensor. When it is determined that the sheet has been detected (YES in step S603), in step S604, the clock count of the first conveyance motor 201 is started to calculate the conveyance position of the sheet.

Next, in step S605, it is determined whether the sheet has reached the movement position of the stopper set in step S602. When it is determined that the sheet has reached the movement position of the stopper (YES in step S605), in step S606, movement of the skew correction stopper 206 is started. Then, in step S607, when acceleration of the skew correction stopper 206 to the sheet conveyance speed V1 is completed, in step S608, it is determined whether the sheet has reached the striking position. When it is determined that the sheet has reached the striking position (YES in step S608), in step S609, the skew correction stopper 206 starts decelerating to the movement speed V2.

In step S609, when the skew correction stopper 206 starts deceleration, in step S610, the sheet is struck on the skew correction stopper 206. In step S611, a loop is formed while the rear end of the sheet is moving at the sheet conveyance speed V1 and the tip of the sheet is moving at the movement speed V2 to execute skew correction.

In step S612, the sheet subjected to skew correction is guided to the second conveyance roller 202 by the skew correction stopper 206. In step S613, when guiding to the second conveyance roller 202, the skew correction stopper 206 retreats outside the conveyance path. In step S614, after the retreat of the skew correction stopper 206, the sheet reaches the second conveyance roller 202. In step S615, the skew correction stopper 206 is stopped after it moves to the HP position and stands by.

Thus, the skew correction stopper 206 moves at the same speed as the sheet conveyance speed V1, the sheet is struck during deceleration to the movement speed V2, a loop is formed by a speed difference between the movement speed V2 and the sheet conveyance speed V1, and a skew can be corrected.

Also in the present exemplary embodiment, similarly to the above-described other exemplary embodiments, damage to a sheet caused by an impact in striking in high-speed conveyance can be reduced. Further, since the skew correction stopper 206 decelerates after a sheet has been struck, the predetermined amount of loop can be formed in a short time. Thus, secure skew correction can be executed. Also in the present exemplary embodiment, similarly to the above-described other exemplary embodiments, a change of the amount of loop in skew correction can be executed.

Figure 16:
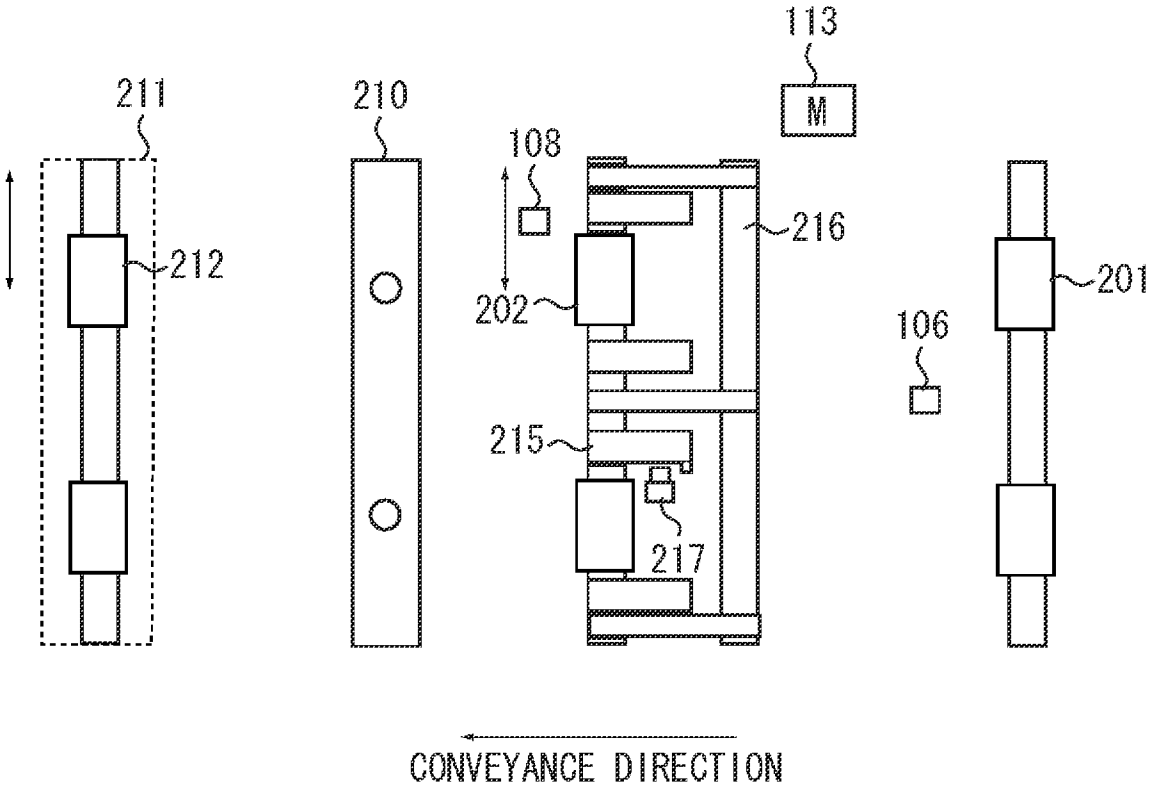
FIG. 16 illustrates skew correction of a sheet processing apparatus according to a fourth exemplary embodiment of the present invention.

Next, a fourth exemplary embodiment of the present invention will be described below. A configuration of a sheet processing apparatus in the present exemplary embodiment will be described referring to FIG. 16.

Similar to the first to third exemplary embodiments, the first conveyance roller 201, the sheet detection sensor 106, the second conveyance roller 202, the horizontal registration detection sensor 108, the punch unit 210, and the shift unit 211 are disposed from the upstream in the sheet conveyance direction.

A rotation stopper 215 is mounted on the shaft of the second conveyance roller 202, and can independently be driven of drive of the second conveyance roller 202. The rotation stopper 215 is rotatable about the second conveyance roller 202. A rotation stopper roller 216 is rotated, thereby transmitting drive.

The rotation stopper roller 216 is rotated by driving the skew correction stopper motor 113. Further, the rotation stopper roller 216 includes a rotation stopper HP sensor 217 with which a position of the rotation stopper 215 can be detected.

Figures 17A, 17B, 17C:
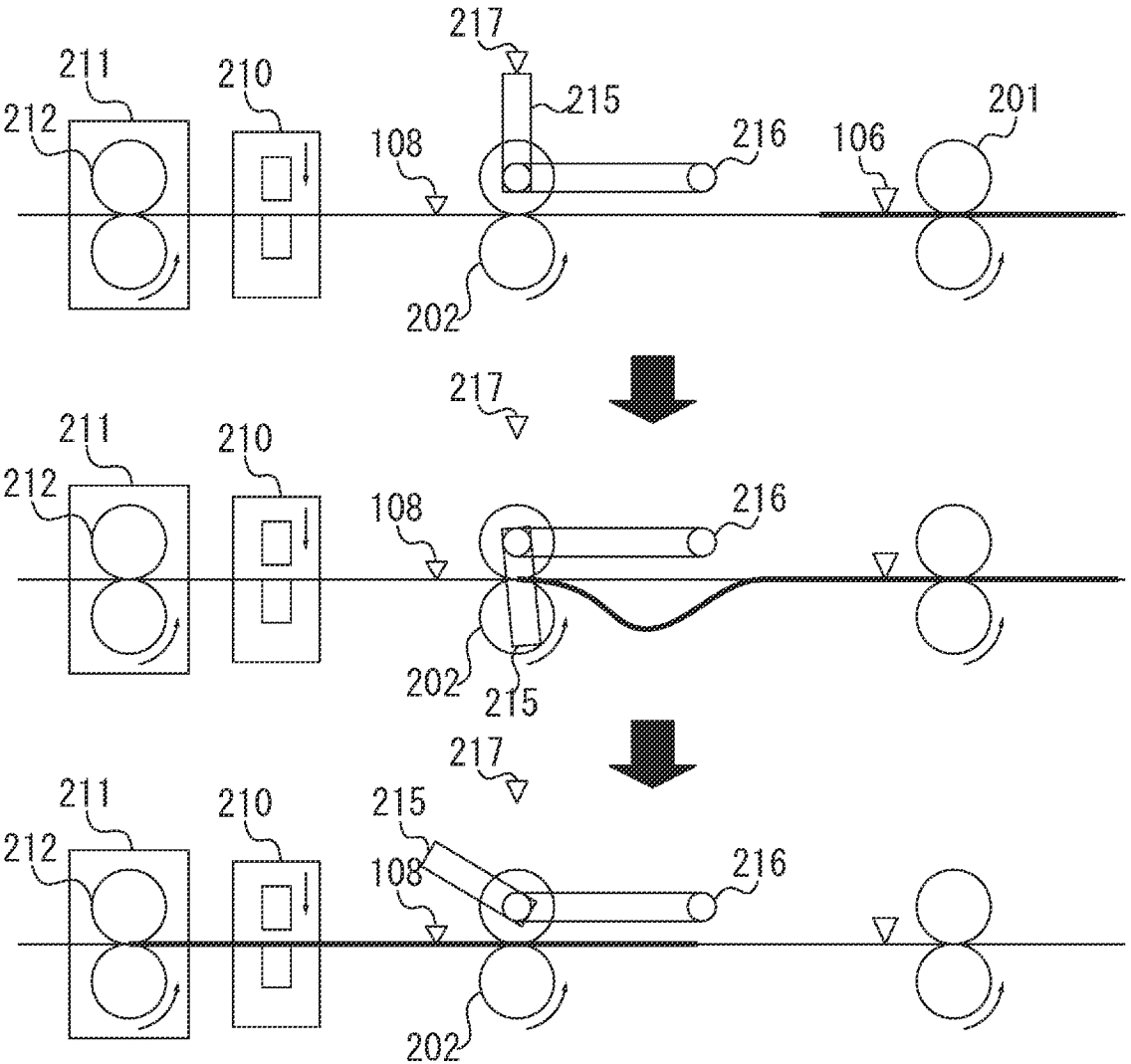
FIGS. 17A, 17B and 17C illustrate skew correction of the sheet processing apparatus.

An operation on the sheet processing apparatus in the present exemplary embodiment will be described referring to FIGS. 17A, 17B, and 17C. The rotation stopper 215 stands by in an HP (standby) position to be detected by the rotation stopper HP sensor 217 until a sheet is conveyed (refer to FIG. 17A).

In order to reduce an impact when the sheet is struck, the sheet is struck while rotating the rotation stopper 215 to execute skew correction. Thus, the rotation stopper 215 stands by in the HP position until the sheet reaches the movement start position. When the sheet reaches the movement start position, the rotation stopper roller 216 is rotated. Thus, the rotation stopper 215 starts moving.

When the rotation stopper 215 accelerates to the movement speed V2 in the predetermined sheet abutting position on the rotation stopper 215, and the sheet reaches the striking position, the sheet is struck on the rotation stopper 215. The sheet is conveyed at the sheet conveyance speed V1 faster than the movement speed V2 in the sheet abutting position on the rotation stopper 215. Thus, a loop is formed by a speed difference and a skew is corrected (refer to FIG. 17B).

In synchronization with the sheet conveyance speed, the rotation stopper 215 is rotated. Thus, an impact in striking is reduced and damage can be reduced. Further, the sheet is conveyed with a loop formed, and the rotation stopper 215 retreats outside the conveyance path in the place of the second conveyance roller 202 (refer to FIG. 17C). The sheet is guided to the second conveyance roller 202 with a loop formed, a skew is corrected, and delivery to the second conveyance roller 202 is executed while keeping the skew correction state.

In processing on the downstream from the second conveyance roller 202 in the sheet conveyance direction, similarly to that in the first exemplary embodiment, a horizontal registration detection operation, a shift operation, and punch processing are executed.

As the rotation stopper 215, skew correction is executed also by a rotation member, thereby controlling a speed in sheet striking and reducing an impact in striking in high-speed conveyance. Thus, damage to a sheet can be reduced.

The skew correction described in the above-described exemplary embodiments has been executed by forming a loop with a speed difference in a conveyance speed between the tip and the rear end of a sheet to be conveyed. However, it is not limited to this. For example, holding pressure of a first conveyance roller, which holds and conveys a sheet at a lower pressure, may be set so that the sheet and the first conveyance roller may slip without forming a loop when the tip of a conveyance sheet has been struck on a stopper and skew correction has been executed.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2009-155679 filed Jun. 30, 2009 and No. 2010-111539 filed May 13, 2010, which are hereby incorporated by reference herein in their entirety.

What is claimed is:

1. An apparatus comprising:

a first conveyance portion configured to convey a sheet at a first speed;

a second conveyance portion disposed downstream of the first conveyance portion in a conveyance direction;

a skew correction portion movably disposed between the first and second conveyance portions along the conveyance direction, and configured to be struck by a downstream end in the conveyance direction of the sheet; and a controller configured to control the first conveyance portion and the skew correction portion, so that the first conveyance portion strikes the sheet against the skew correction portion having a moving speed slower than the first speed and conveys the sheet to the second conveyance portion with the sheet being struck, and so that a striking position in the conveyance direction between the sheet and the skew correction portion is changed to upstream in the conveyance direction as a rigidity of the sheet is greater.

2. The apparatus according to claim 1, wherein the controller controls the first conveyance portion and the skew correction portion so that the first conveyance portion strikes the sheet against the skew correction portion that is moving at the speed slower than the first speed of the sheet conveyed by the first conveyance portion to form a loop of the sheet.

3. The apparatus according to claim 2, wherein the controller adjusts an amount of the loop to be formed on the sheet by changing a movement speed of the skew correction portion.

4. The apparatus according to claim 1, wherein the controller controls the first conveyance portion and the skew correction portion so that the first conveyance portion strikes the sheet against the skew correction portion while the skew correction portion is moving at a constant speed.

5. The apparatus according to claim 1, wherein the controller controls the first conveyance portion and the skew correction portion so that the first conveyance portion strikes the sheet against the skew correction portion while the skew correction portion is accelerating.

6. The apparatus according to claim 1, wherein the controller controls the first conveyance portion and the skew correction portion so that the first conveyance portion strikes the sheet against the skew correction portion while the skew correction portion is decelerating.

7. The apparatus according to claim 1, wherein the rigidity of the sheet is determined based on one of a type of paper, thickness and grammage of the sheet.

8. A processing apparatus comprising:

a processing unit configured to execute processing to a sheet;

a first conveyance portion configured to convey the sheet to be executed processing at a first speed;

a second conveyance portion disposed downstream of the first conveyance portion in a conveyance direction;

a skew correction portion movably disposed between the first and second conveyance portions along the conveyance direction, and configured to be struck by a downstream end in the conveyance direction of the sheet;

a controller configured to control the first conveyance portion and the skew correction portion, so that the first conveyance portion strikes the sheet against the skew correction portion having a moving speed slower than the first speed and conveys the sheet to the second conveyance portion with the sheet being struck, and so that a striking position in the conveyance direction between the sheet and the skew correction portion is changed to upstream in the conveyance direction as a rigidity of the sheet is greater.

9. The processing apparatus according to claim 8, wherein the controller controls the first conveyance portion and the skew correction portion so that the first conveyance portion strikes the sheet against the skew correction portion that is moving at a speed slower than the first speed of the sheet conveyed by the first conveyance portion to form a loop of the sheet.

10. The processing apparatus according to claim 9, wherein the controller adjusts an amount of the loop to be formed on the sheet by changing a movement speed of the skew correction portion.

11. The processing apparatus according to claim 9, wherein the controller controls the first conveyance portion and the skew correction portion so that the first conveyance portion strikes the sheet against the skew correction portion while the skew correction portion is accelerating.

12. The processing apparatus according to claim 9, wherein the controller controls the first conveyance portion and the skew correction portion so that the first conveyance portion strikes the sheet against the skew correction portion while the skew correction portion is decelerating.

13. The processing apparatus according to claim 8, wherein the controller controls the first conveyance portion and the skew correction portion so that the first conveyance portion strikes the sheet against the skew correction portion while the skew correction portion is moving at a constant speed.

14. The processing apparatus according to claim 8, wherein the rigidity of the sheet is determined based on one of a type of paper, thickness and grammage of the sheet.

15. An image forming apparatus comprising:

an image forming portion configured to form an image on a sheet;

a first conveyance portion configured to convey the image formed on the sheet at a first speed;

a second conveyance portion disposed downstream of the first conveyance portion in a conveyance direction;

a skew correction portion movably disposed between the first conveyance portion and the second conveyance portion along the conveyance direction, and configured to be struck by a downstream end in the conveyance direction of the sheet, and a controller configured to control the first conveyance portion and the skew correction portion, so that the first conveyance portion strikes the sheet against the skew correction portion having a moving speed slower than the first speed, and conveys the sheet to the second conveyance portion with the sheet being struck, and so that a striking position in the conveyance direction between the sheet and the skew correction portion is changed to upstream in the conveyance direction as a rigidity of the sheet is greater.

16. The image forming apparatus according to claim 15, wherein the controller controls the first conveyance portion and the skew correction portion so that the first conveyance portion strikes the sheet against the skew correction portion that is moving at a speed slower than the conveyance speed of the sheet to be conveyed by the first sheet conveyance portion to form a loop of the sheet.

17. The image forming apparatus according to claim 16, wherein an amount of the loop, which is formed on the sheet, is adjusted, by changing a movement speed of the skew correction portion.

18. The image forming apparatus according to claim 15, wherein the controller controls the first conveyance portion and the skew correction portion so that the first conveyance portion strikes the sheet against the skew correction portion while the skew correction portion is moving at a constant speed.

19. The image forming apparatus according to claim 15, wherein the controller controls the first conveyance portion and the skew correction portion so that the first conveyance portion strikes the sheet against the skew correction portion while the skew correction portion is accelerating.

20. The image forming apparatus according to claim 15, wherein the controller controls the first conveyance portion and the skew correction portion so that the first sheet conveyance portion strikes the sheet while the sheet skew correction portion is decelerating.

21. The image forming apparatus according to claim 15, wherein the rigidity of the sheet is determined based on one of a type of paper, thickness and grammage of the sheet.

* * * * *